US005152301A

United States Patent [19]

Kittelsen et al.

[11] Patent Number: 5,152,301

[45] Date of Patent: Oct. 6, 1992

[54] MOUTHGUARD

[75] Inventors: Jon D. Kittelsen, Fridley; Norm J. V. McMillan, Plymouth, both of Minn.

[73] Assignee: E-Z Gard Industries, Inc., Minneapolis, Minn.

[21] Appl. No.: 760,118

[22] Filed: Sep. 16, 1991

[51] Int. Cl.[5] ..... A61F 5/34

[52] U.S. Cl. ..... 128/861; 128/846

[58] Field of Search ..... 128/846, 857, 859, 861, 128/862; 602/5, 6, 17

[56] References Cited

U.S. PATENT DOCUMENTS

| | | | |
|---|---|---|---|
| 2,694,397 | 11/1954 | Herms . | |
| 3,058,462 | 10/1962 | Greenblum . | |
| 3,082,765 | 3/1963 | Helmer . | |
| 3,124,129 | 3/1964 | Grossberg . | |
| 3,203,417 | 8/1965 | Helmer . | |
| 3,233,085 | 12/1965 | Gores et al. | 128/861 |
| 3,312,218 | 4/1967 | Jacobs . | |
| 3,407,809 | 10/1968 | Ross . | |
| 3,411,501 | 11/1968 | Greenberg . | |
| 3,448,738 | 6/1969 | Berghash . | |
| 3,485,242 | 12/1969 | Greenberg . | |
| 3,496,396 | 2/1970 | Gores | 128/861 |
| 3,513,838 | 5/1970 | Foderick et al. | 128/861 |
| 3,518,988 | 7/1970 | Gores | 128/861 |
| 3,768,465 | 10/1973 | Helmer . | |
| 3,864,832 | 2/1975 | Carlson | 128/862 |
| 3,943,924 | 3/1976 | Kallestad et al. . | |
| 4,063,552 | 12/1977 | Going et al. | 128/861 |
| 4,114,614 | 9/1978 | Kesling | 128/861 |
| 4,337,765 | 7/1982 | Zimmerman | 128/861 |
| 4,672,959 | 6/1987 | May et al. . | |
| 4,791,941 | 12/1988 | Schaefer . | |
| 4,977,905 | 12/1990 | Kittelsen . | |

OTHER PUBLICATIONS

"Mouth Protectors: Give Your Teeth A Sporting Chance": 1985 Am. Dental Assn. & Academy of Sports Dentistry.

"Muscular Strength Correlated to Jaw Posture And The Temporomandibular Joint" by Stephen D. Smith D.M.D. NYS Dental Journal, vol. 44, No. 7, Aug.-Sep., 1978.

*Primary Examiner*—Robert A. Hafer
*Assistant Examiner*—Sam Rimell
*Attorney, Agent, or Firm*—Palmatier & Sjoquist, PA

[57] ABSTRACT

A thermoplastic mouthguard has a U-shaped base with top and bottom sides and upward inner lingual and outer labial walls forming a channel for the upper jaw teeth having posterior and anterior portions. Occlusal posterior pads are on the bottom side of the base along the posterior portions of the guard to space apart the anterior teeth of the lower jaw from the anterior portion of the bottom side of the U-shaped base and to lessen pressure and possible impact forces exerted at the temporomandibular joint. Occlusal impact chambers are located within the occlusal posterior pads for shock dissipation and absorption. Anteriorly directed ridges are located along the bottom of the impact surfaces of the occlusal posterior pads for custom fitting of the mouthguard and tending to move the lower jaw anteriorly when a force impact is imposed upon the lower jaw. An anterior impact brace is located along the anterior portion of the outer labial wall. A connecting tab may extend from the mouthguard for connecting the guard to a fastening point on the user. A rigid framework tray is provided for assisting in heating the mouthguard and positioning and aligning the mouthguard for custom formation to the user's mouth.

17 Claims, 2 Drawing Sheets

MOUTHGUARD

BACKGROUND OF THE INVENTION

This invention relates generally to a protective mouthguard for use by athletes and the like and more particularly to a custom formed mouthguard that assists in proper jaw posture to increase body muscular strength while yet further having additional teeth, jaw and joint protecting features.

A number of mouthguards currently exist in the art for protecting the teeth and for reducing the chance of shock, concussions and other injuries as a result of high impact collisions and blows during athletic competition. Mouthguards generally are characterized as being nonpersonalized, universal and stock model type, or are formed to have direct upper jaw tooth-formed contact. Additionally, the mouthguards may be tethered or untethered. Mouthguards may be tethered to a fastening point, such as a helmet or faceguard, to prevent the chance of the mouthguard from being lost as well to prevent swallowing of the mouthguard or choking on the mouthguard by the user.

The lack of a mouthguard or the use of improperly fitted mouthguards when impacts, collisions or blows occur to the jaw structure of an athlete have recently been found to be responsible for athletes' susceptibility to headaches, presence of earaches, ringing in the ears, clogged ears, vertigo, concussions and dizziness. The cause of these types of health problems and injuries are generally not visible by inspection of the mouth or jaw but more particularly relate to the temporomandibular joints (TMJ) and surrounding tissues where the lower jaw is connected to the skull in the proximity where the auriculo-temporalis nerves and supra-temporal arteries pass from the neck nerves and supra-temporal arteries pass from the neck into the skull to the brain.

There is a need for a custom fit mouthguard with direct upper jaw tooth-formed contact for a user which will facilitate breathing and speech as well as reduce pressure and possible concussion impact upon the cartilage of the joint, the joint itself, the arteries and the nerves in proximity of the joints.

SUMMARY OF THE INVENTION

A thermoplastic mouthguard has a U-shaped base with top and bottom sides and upward inner lingual and outer labial walls forming a channel for the upper jaw teeth having posterior and anterior portions. Occlusal posterior pads are on the bottom side of the base along the posterior portions of the guard to space apart the anterior teeth of the lower jaw from the anterior portion of the bottom side of the U-shaped base and to lessen pressure and possible impact forces exerted at the temporomandibular joint. Occlusal impact chambers are located within the occlusal posterior pads for shock dissipation and absorption. Anteriorly directed ridges are located along the bottom of the impact surfaces of the occlusal posterior pads for custom fitting of the mouthguard and tending to move the lower jaw anteriorly when a force impact is imposed upon the lower jaw. An anterior impact brace is located along the anterior portion of the outer labial wall. A connecting tab may extend from the mouthguard for connecting the guard to a fastening point on the user. A rigid framework tray is provided for assisting in heating the mouthguard and positioning and aligning the mouthguard for custom formation to the user's mouth.

A principle object and advantage of the present invention is that the mouthguard with its occlusal posterior pads permits easy breathing when using the mouthguard and permits the user to readily speak while wearing the mouthguard as heretofore not known.

Another object and advantage of the present invention is that the occlusal posterior pads lower the condyle downwardly with respect to the joint thereby prohibit temporomandibular joint injury by way of the condyle wearing or moving the cartilage or disc of the temporomandibular joint out of position or the condyle possibly breaking the temporal bone resulting in extreme injury or death.

Another object and advantage of the present invention is that the occlusal posterior pads, once the mouthguard has been fitted on the user, creates more freedom for the auriculo-temporalis nerve and supratemporal artery by way of moving the condyle downwardly and forwardly away from these nerves and arteries which will increase body muscular strength, greater endurance and improved performance by the mouthguard user.

Another object and advantage of the present invention is that the bottom surface of the occlusal posterior pads have forwardly directed ridges, steps or wedge-shaped grooves which assist in custom fitting with the user and which tend to move the lower jaw forwardly upon an impact force being applied to the lower jaw rather than upwardly and rearwardly which would cause injury to the temporal mandibular joint and surrounding tissues of the user.

Another object and advantage of the present invention is that the labial anterior impact brace along the anterior portion of the labial wall assists in shock dissipation which would otherwise be applied to the anterior teeth of the upper jaw.

Another object and advantage of the present invention is that the occlusal impact chambers within the occlusal posterior pads further absorb and spread out lower jaw impact forces which otherwise may be transmitted to the temporomandibular joint, surrounding tissues or the upper jaw.

Another object and advantage of the present invention is that the frame work tray assists in holding the mouthguard during its heating just before fitting of the mouthguard within the user's mouth. The frame work tray also assists in aligning the mouthguard for fitting with respect to the upper and lower jaws as well as maintaining the size and shape of the heated, soft pliable mouthguard, the connecting tab and slot, and the occlusal impact chambers.

DETAILED SPECIFICATION

Figure 1:
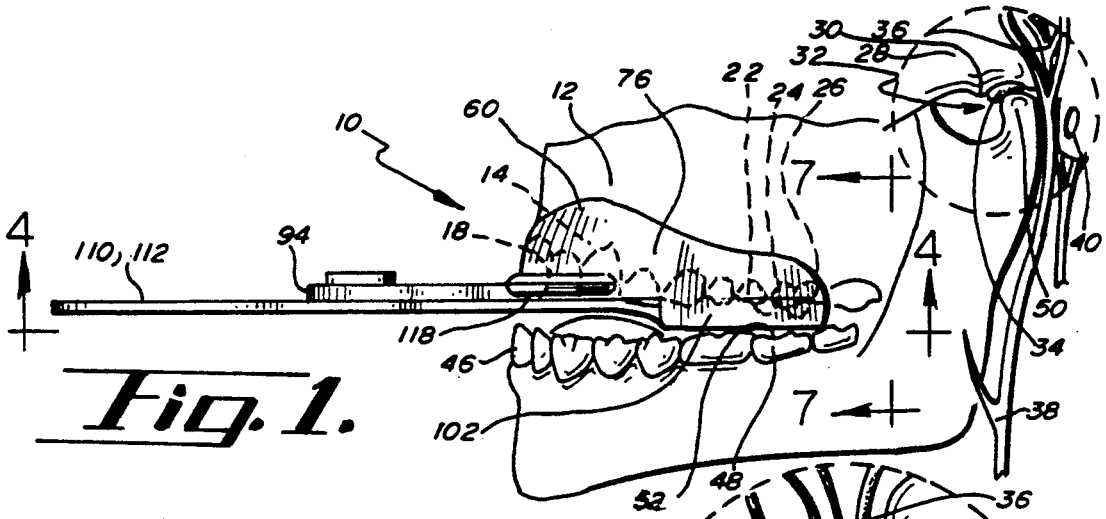
FIG. 1 is a maxillary mandibular buccal or partial side elevational view of the jaws and temporomandibular joint of a user of the mouthguard of the present invention.
Figure 1A:
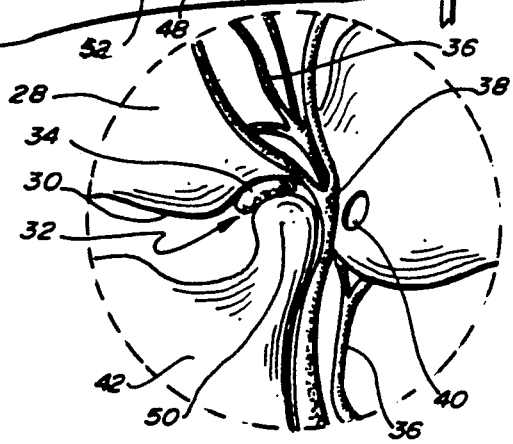
FIG. 1A is an enlarged view of the circled temporomandibular joint portion of FIG. 1.
Figure 7:
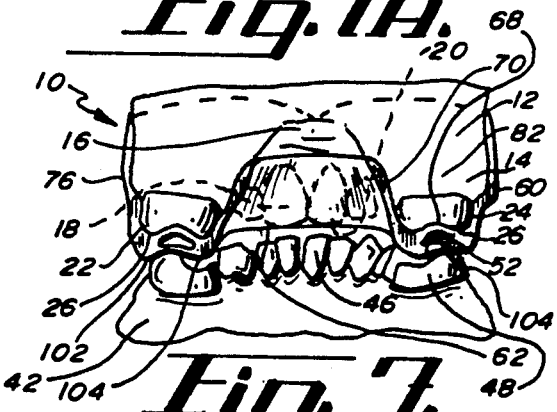
FIG. 7 is a view taken along lines 7—7 of FIG. 1.
Figure 8:
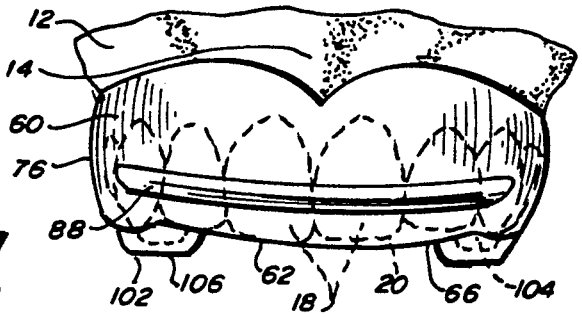
FIG. 8 is a front elevational view of the mouthguard of the present invention fitted onto the upper jaw of the user.
Figure 5:
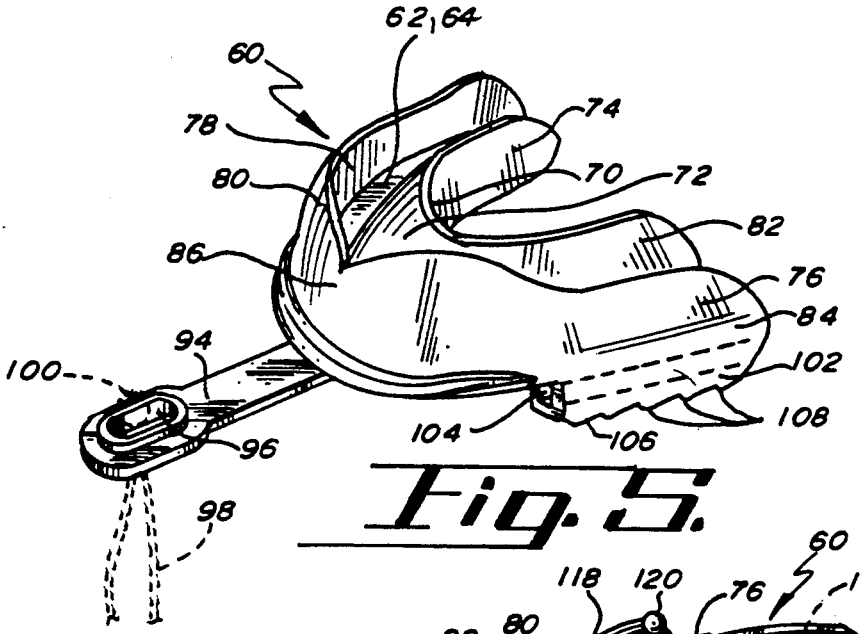
FIG. 5 is a perspective view of the mouthguard of the present invention.

To understand the structural features and benefits of the mouthguard 60 of the present invention, some anatomy will first be described. Referring to FIGS. 1, 1A and 7, the mouthguard 60 user would have a mouth 10, generally comprised of a rigid upper jaw 12 and a movable lower jaw 42 which are movably connected at the temporomandibular joint (TMJ) 32 and 50.

More specifically, the rigid upper jaw 12 has gum tissue 14 and a palate 16 within mouth 10. Gum tissue 14, as well as the bone thereunder, support anterior teeth (incisors and canines) 18 which have an incisal or biting surface 20. The gum tissues 14 and the bone thereunder also support posterior teeth (molars and bicuspids) 22 which have cusps 24. The posterior teeth 22 have occlusal or biting surfaces 26.

Referring to one side of the human head, the temporal bone 28 is located upwardly and rearwardly of the upper jaw 12 and is in the range of 1/16 to 1/32 inch thick. The articular eminence 30 forms the beginning of the fossa 32 or the socket of the temporomandibular joint 32 and 50. Rearwardly or posteriorly to the articular eminence 30 is located cartilage 34. Through the temporomandibular joint 32 and 50 pass the auriculo-temporalis nerve 36 and the supra-temporal artery. Posteriorly to this structure is located the inner ear 40.

The movable jaw or mandible 42 supports a bone covered by gum tissue 44 which further supports anterior teeth (incisors and canines) 46 and posterior teeth (molars and bicuspids) 48 with occlusal surfaces 52. The condyle 50 of the lower jaw 42 forms the ball of the temporomandibular joint 32 and 50. This anatomical structure is the sam for both sides of the head.

Repeated impacts, collisions, blows or forces exerted on the movable lower jaw 42 results in excessive wearing forces upon the condyle 50 and the cartilage or disc 34—typically resulting in deterioration or slippage of the cartilage 34. Thereafter, the lower jaw 42 may be subject to irregular movement, loss of comfortable range of movement, and clicking of the joint 32 and 50.

The auriculo-temporalis nerve 36 relates to both sensory and motor activities of the body. Any impingement or pinching of this nerve 36 can result in health problems as previously mentioned. The supratemporal artery 38 is important in that it provides blood circulation to the head. Impingement, pinching, rupture or blockage of this artery 38 will result in possible loss of consciousness and reduced physical ability and endurance due to the restriction of blood flow to the brain. Thus, it is extremely important to assure that the condyle 50 does not impinge upon the auriculo-temporalis nerve 36 or the supra-temporal artery 38.

It is also important to note that the temporal bone 28 is not too thick. Medical science has known that a sharp shock or concussive force applied to the lower jaw 42 possibly could result in the condyle 50 protruding through the temporal bone 28 thereby causing death. This incident rarely, but sometimes, occurs with respect to boxing athletes.

Mouthguard 60 generally is horse shoe or U-shaped and suitably may be made of a one piece or integral thermal plastic that is readily shapable at temperatures above body temperatures while yet holding its shape at body temperature. Suitably safe material for the mouthguard 60 would include ethylene vinyl acetate copolymers or particularly ethyl vinyl acetate which is commercially available.

Referring to FIGS. 1–8, the mouthguard 60 generally includes its U-shaped base 62, upward inner lingual and outer labial walls 70 and 76, anterior impact brace 88, connecting tab 94, occlusal posterior pads 102 with chambers 104 and a frame work tray 110.

More particularly, mouthguard 60 has a U-shaped base 62 which has a top side 64 and a lower side 66. The base 62 is substantially flat and overlies the biting (occlusal and incisal) surfaces of the teeth 18, 22, 46 and 48 of the upper and lower jaws 12 and 42. After the mouthguard has been heated and fitted within the user's mouth, the upper occlusal index 68 (FIG. 6) is formed for properly indexing the mouthguard 60 by the user onto his upper jaw 12. Joining the U-shaped base 62 is upward, inner lingual wall 70 having an inner surface 72 and an outer surface 74. Also joining the base 62 is upward, outer labial wall 76 having an inner surface 78 and outer surface 80. By this arrangement, channel 82 is formed for receiving the teeth 18 and 22 of the upper jaw 12. Generally, the mouthguard 60 has a posterior portion 84 and an anterior portion 86.

Suitably an anterior impact brace 88 lies along the outer surface 80 of the outer wall 76 of the anterior portion 86 of the mouthguard 60 and resembles a protruding or rib-like structure along the anterior teeth 18 of the upper jaw 12.

A quick release connecting tab 94 is suitably formed integral with the mouthguard 60 and has a reinforced slot 96 which may take the shape of an opening or an aperture to receive a ball, knot or bead 100 connected to string, cord or tether 98. The cord or tether 98 may then be fastened to a fastening point on the user such as a faceguard or a helmet.

The occlusal posterior pads 102 are integrally formed upon the lower side 66 of the U-shaped base 62 below occlusal surfaces 26 of the upper jaw 12 and also along the posterior portion 84 of the mouthguard 60. The occlusal posterior pads 102 suitably may be of a height between 2 to 4 millimeters with a principle purpose of relieving pressure upon the cartilage or disc 34 upon impact.

The occlusal impact chambers 104 are suitably elongate and formed within the occlusal posterior pads 102. The chambers 104 suitably may be open, closed (FIG. 8) or filled with a cushioning media such as air, gel, neoprene or the like.

The bottom impact surface 106 of the occlusal posterior pads 102 suitably has forwardly or anteriorly directed ridges, steps or wedge-shaped grooves 108 which collapse or fold in a forward motion similar to a domino effect upon exertion by the posterior teeth 48 of the lower jaw 42 as to further assure that the condyle 50 does not move rearwardly to damage the cartilage 34 or impinge upon the auriculo-temporalis nerve 36 or supra-temporal artery 38. If desired, lower occlusal index 68*a* may be formed by indexing the bottom impact surface 106 of heated mouthguard 60 with the occlusal surfaces 52 of the posterior teeth 48 of the lower jaw 42.

The frame work tray 110 is suitably of a rigid plastic, such as styrene or nylon, which will suitably withstand heated liquids at a temperature of 100° C. which is necessary for softening the mouthguard 60 just prior to fitting within the user's mouth 10.

The frame work tray 110 advantageously has a handle 112 which supports a raised portion 114 designed to secure the reinforced slot 96 of the quick release connecting tab 94. By this arrangement, the size and shape of the tab 94 and slot 96 are maintained to guarantee the integrity of the release mechanism with respect to the tether or cord 90 and its ball or bead 100.

Figure 4:
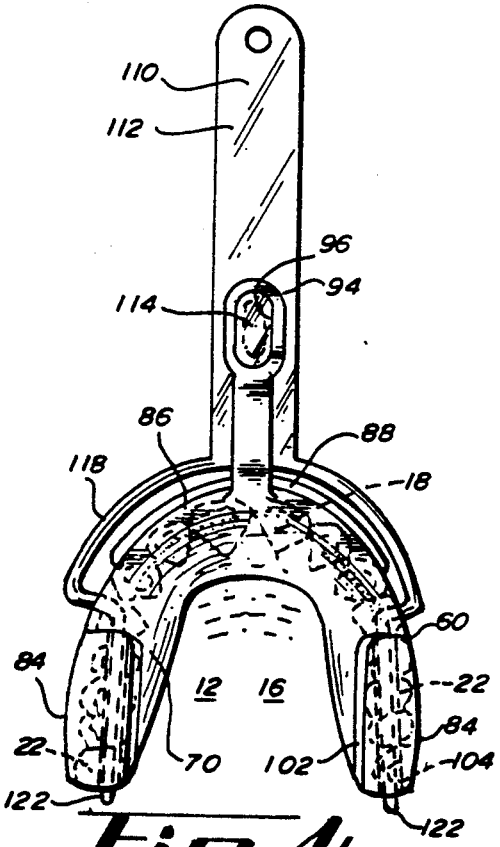
FIG. 4 is a cross-sectional view taken along lines 4—4 of FIG. 1.
Figure 2:
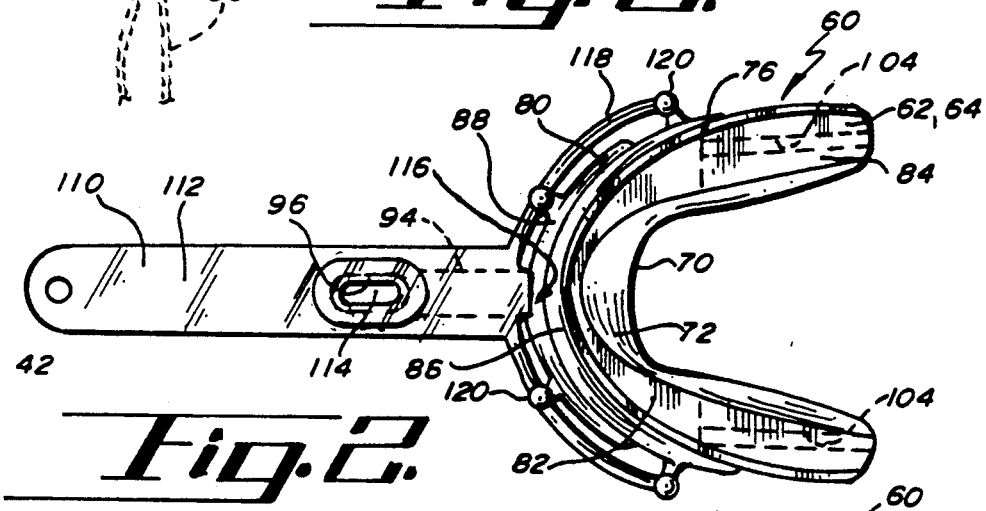
FIG. 2 is a top plan view of the mouthguard and tray of the present invention.
Figure 3:
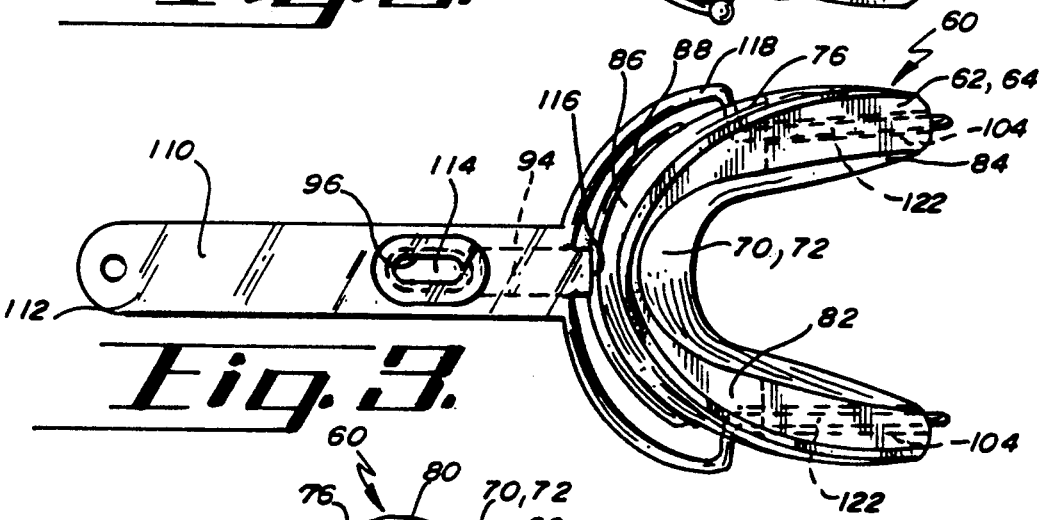
FIG. 3 is a top plan view of the mouthguard and modified tray of the present invention.
Figure 6:
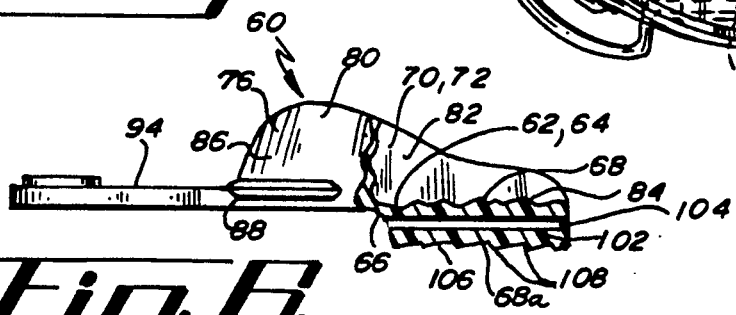
FIG. 6 is a side elevational view partially broken away of the mouthguard of the present invention after custom fitting showing the occlusal index.

The frame work tray 110 also may have a mouthguard indexing tab 116 and an arcuate mouthguard frame portion 118 to assure the shape of the mouthguard 60 during heating and positioning within the user's mouth 10. The arcuate frame portion 118 may be connected to bulbous portions 120 of the mouthguard 60 as shown in FIG. 2. Bulbous portions 120 may later be removed by cutting from mouthguard 60. Alternatively, the arcuate mouthguard frame portion 18 may have support impact chamber support stems or rods 122 as shown in FIGS. 3 and 4. With this arrangement, stems 122 are withdrawn from impact chambers 104 as tray 110 is pulled away from formed mouthguard 60.

Before the fitting of the mouthguard 60 to a user's upper jaw 12, the user should be examined by medical personnel for jaw posture movement and position as well as the condition and health of the temporomandibular joints and surrounding tissues.

With this knowledge, the mouthguard 60 is submersed into suitably boiling water for approximately 12 seconds. Thereafter, the mouthguard is immediately placed onto the teeth 18 and 22 of the upper jaw 12. Next, the lower jaw 42 is positioned forwardly or anteriorly in a range of 1 to 4 millimeters depending upon the jaw posture and condition found by the previously mentioned examination. Thereafter, the teeth 46 and 48 of the lower jaw 42 are engaged with the bottom impact surface 106 of the occlusal posterior pads 102 as the frame work tray and handle 112 is held to assure proper positioning of the mouthguard 60 within the user's mouth. The user then should apply suction between the upper jaw 12 and the mouthguard 60 while packing the mouthguard 60 with hands along the cheeks and lips adjacent the anterior and posterior teeth 18 and 22 of the upper jaw 12. With the posterior teeth 48 of the lower jaw 42 properly positioned and indexed upon the bottom impact surface 106 of the occlusal posterior pads 102, the user will have correct jaw posture for athletic participation which will assure minimal impact injury to the temporomandibular joint 32 and surrounding tissue as well as to the teeth of the respective jaws. Furthermore, the user will experience increased endurance performance and muscular strength due to the freedom within the temporomandibular joints 32 provided to the articulo-temporalis nerves and supra-temporal arteries 38.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

We claim:

1. A thermal plastic mouthguard for a user having an upper jaw with anterior teeth, posterior teeth with occlusal surfaces, and fossae with cartilage forming sockets, and a movable lower jaw with anterior teeth, posterior teeth with occlusal surfaces and cordyles movably fitted within the sockets forming the temporomandibular joints through which the auriculo-temporalis nerves and supra-temporal arteries pass, the mouthguard comprising:

(a) a U-shaped base with top and bottom sides and upward inner lingual and outer labial walls forming a channel for the upper jaw teeth having posterior and anterior portions;

(b) occlusal posterior pads on the bottom side of the base along only the posterior portions to space apart the anterior teeth of the lower jaw from the anterior portion of the bottom side of the U-shaped base to facilitate breathing and speech and to lessen condyles pressure and impact upon the cartilage, and temporomandibular joints, the arteries and the nerves;

(c) an occlusal impact chamber within each occlusal posterior pad for dissipation and absorption of shock imposed upon the lower jaw; and (d) an anterior impact brace along the anterior portion of the outer labial wall.

2. The mouthguard of claim 1, wherein the impact chambers are closed.

3. The mouthguard of claim 2, wherein the impact chambers are filled with a cushioning media.

4. The mouthguard of claim 1, wherein the impact chambers are open.

5. The mouthguard of claim 1, further comprising anteriorly directed ridges along bottom impact surfaces of the occlusal posterior pads tending to move the lower jaw anteriorly as ridges collapse anteriorly when a force impact is imposed upon the lower jaw.

6. The mouthguard of claim 1, further comprising an anterior impact brace along the anterior portion of the outer labial wall for releasably connecting the mouthguard to a fastening point on the user to prevent loss of the mouthguard and swallowing on the mouthguard.

7. The mouthguard of claim 1, further comprising a rigid frame work tray with a frame portion releasably secured and supporting the mouthguard and a handle for grasping when inserting the mouthguard and the frame portion into a hot liquid, the frame work tray for assisting in the positioning and alignment of the mouthguard for formation in the user's mouth.

8. An integral, thermal plastic mouthguard for a user having an upper jaw with anterior teeth, posterior teeth with occlusal surfaces, and fossae with cartilage forming sockets, and a moveable lower jaw with anterior teeth, posterior teeth with occlusal surfaces and cordyles movably fitted within the sockets forming the temporomandibular joints through which the auriculo-temporalis nerves and supra-temporal arteries pass, the mouthguard comprising:

(a) a U-shaped base with top and bottom sides and upward inner lingual and outer labial walls forming a channel for the upper jaw teeth having posterior and anterior portions;

(b) occlusal posterior pads on the bottom side of the base along the posterior portions to space apart the anterior teeth of the lower jaw from the anterior portion of the bottom side of the U-shaped base to facilitate breathing and speech and to lessen condyles pressure and impact upon the cartilage, the temporomandibular joints, the arteries and the nerves;

(c) occlusal impact chambers within the occlusal posterior pads for dissipation and absorption of shock imposed upon the lower jaw; and (d) a rigid frame work tray with a frame portion releasably secured and supporting the mouthguard and a handle for grasping when inserting the mouthguard and the frame portion into a hot liquid, the frame work tray for assisting in the positioning and alignment of the mouthguard for formation in the user's mouth.

9. The mouthguard of claim 8, further comprising anteriorly directed ridges along bottom impact surfaces of the occlusal posterior pads tending to move the lower jaw anteriorly as ridges collapse anteriorly when a force impact is imposed upon the lower jaw.

10. The mouthguard of claim 8, wherein the impact chambers are closed.

11. The mouthguard of claim 10 wherein the impact chambers are filled with a cushioning media.

12. The mouthguard of claim 8, wherein the impact chambers are open.

13. The mouthguard of claim 8, further comprising an anterior impact brace along the anterior portion of the outer labial wall.

14. The mouthguard of claim 8, further comprising a connecting tab protruding from the anterior portion of the outer labial wall for releasably connecting the mouthguard to a fastening point on the user to prevent loss of the mouthguard and swallowing of the mouthguard.

15. An integral, thermal plastic mouthguard for a user having an upper jaw with anterior teeth, posterior teeth with occlusal surfaces, and fossae with cartilage forming sockets, and a movable lower jaw with anterior teeth, posterior teeth with occlusal surfaces and cordyles movably fitted within the sockets forming the temporomandibular joints through which the auriculo-temporalis nerves and supra-temporal arteries pass, the mouthguard comprising:

(a) a U-shaped base with top and bottom sides and upward inner lingual and outer labial walls forming a channel for the upper jaw teeth having posterior and anterior portions;

(b) occlusal posterior pads on the bottom side of the base along the posterior portions to space apart the anterior teeth of the lower jaw from the anterior portion of the bottom side of the U-shaped base to facilitate breathing and speech and to lessen condyles pressure and impact upon the cartilage, the temporomandibular joints, the arteries and the nerves;

(c) occlusal impact chambers within the occlusal posterior pads for dissipation and absorption of shock imposed upon the lower jaw;

(d) anteriorly directed ridges along bottom impact surfaces of the occlusal posterior pads tending to move the lower jaw anteriorly as ridges collapse anteriorly when a force impact is imposed upon the lower jaw;

(e) an anterior impact brace along the anterior portion of outer labial wall;

(f) a connecting tab protruding from the anterior portion of the outer labial wall for releasably connecting the mouthguard to a fastening point on the user to prevent loss of the mouthguard and swallowing of the mouthguard; and (g) a rigid frame work tray with a frame portion releasably secured and supporting the mouthguard and a handle for grasping when inserting the mouthguard and the frame portion into a hot liquid, the frame work tray for assisting in the positioning and alignment of the mouthguard for formation in the user's mouth.

16. A method for custom forming a mouthguard with direct upper jaw tooth-formed contact for a user having an upper jaw with anterior teeth, posterior teeth with occlusal surfaces, and fossae with cartilage forming sockets and a movable lower jaw with anterior teeth, posterior teeth with occlusal surfaces and condyles movably fitted within the sockets forming the temporomandibular joints through which the auriculo-temporalis nerves and supra-temporal arteries pass, the method comprising:

(a) examining the user for jaw posture and the position, condition and health of the temporomandibular joints;

(b) heating a thermoplastic formable mouthguard releasably secured and supported by a rigid frame work tray with a handle for grasping, the mouthguard having occlusal posterior pads of a height in the range of 2 to 4 millimeters;

(c) grasping the tray and guiding the heated mouthguard onto the teeth of the upper jaw;

(d) positioning the lower jaw anteriorly in a range of 1 to 4 millimeters;

(e) maintaining alignment of the mouthguard by grasping and holding the tray and engaging with force the lower jaw posterior teeth with the occlusal posterior pads; and (f) applying suction between the upper jaw and the mouthguard while packing the mouthguard with hands along the cheeks and lip adjacent the anterior and posterior teeth of the upper jaw.

17. An integral, thermal plastic mouthguard for a user having an upper jaw with anterior teeth, posterior teeth with occlusal surfaces, and fossae with cartilage forming sockets, and a movable lower jaw with anterior teeth, posterior teeth with occlusal surfaces and cordyles movably fitted within the sockets forming the temporomandibular joints through which the auriculo-temporalis nerves and supra-temporal arteries pass, the mouthguard comprising:

(a) a U-shaped base with top and bottom sides and upward inner lingual and outer labial walls forming a channel for the upper jaw teeth having posterior and anterior portions;

(b) a connecting tab protruding from the anterior portion of the outer labial wall for releasably connecting the mouthguard to a fastening point on the user to prevent loss of the mouthguard and swallowing of the mouthguard; and (c) a rigid frame work tray with a frame portion releasably secured and supporting the mouthguard and the connecting tab and further having a handle for grasping when inserting the mouthguard and the frame portion into a hot liquid, the frame work tray for assisting in the positioning and alignment of the mouthguard for formation in the user's mouth and maintaining the shape and releasability of the connecting tab.

* * * * *

UNITED STATES PATENT AND TRADEMARK OFFICE

CERTIFICATE OF CORRECTION

PATENT NO. : 5,152,301

DATED : October 6, 1992

INVENTOR(S) : Jon D. Kittelsen, Norm J.V. McMillan

It is certified that error appears in the above-identified patent and that said Letters Patent is hereby corrected as shown below:

Column 1, lines 37-38, after "neck", delete "nerves and supra-temporal arteries pass from the neck".

Column 6, lines 36-37, after "comprising", delete "an anterior impact brace along" and replace it with --a connecting tab protruding from--.

Signed and Sealed this

Twenty-fifth Day of January, 1994

*Attest:*

Bruce Lehman

BRUCE LEHMAN

*Attesting Officer*

*Commissioner of Patents and Trademarks*